US007464470B2

(12) United States Patent
Grosh et al.

(10) Patent No.: US 7,464,470 B2
(45) Date of Patent: Dec. 16, 2008

(54) CUTTING APPARATUS FOR PLASTIC-ENCASED AND CORRUGATED PACKAGES

(76) Inventors: Steven R. Grosh, 3309 Carriage Ct., Richardson, TX (US) 75082; Terri L. Grosh, 3309 Carriage Ct., Richardson, TX (US) 75082

( * ) Notice: Subject to any disclaimer, the term of this patent is extended or adjusted under 35 U.S.C. 154(b) by 0 days.

(21) Appl. No.: 11/333,458

(22) Filed: Jan. 17, 2006

(65) Prior Publication Data

US 2007/0163122 A1 Jul. 19, 2007

(51) Int. Cl.
*B67B 7/00* (2006.01)
*B26F 1/00* (2006.01)

(52) U.S. Cl. ..... 30/2; 30/359

(58) Field of Classification Search ..... 30/125, 30/162, 163, 335, 336, 2, 123.7, 359, 364
See application file for complete search history.

(56) References Cited

U.S. PATENT DOCUMENTS

| | | | | | |
|---|---|---|---|---|---|
| 440,835 | A * | 11/1890 | Wickman | 400/136 |
| 4,193,191 | A * | 3/1980 | Sisco | 30/364 |
| 5,093,994 | A * | 3/1992 | Karas | 30/125 |
| 5,495,671 | A * | 3/1996 | Shun-Yi | 30/364 |
| 5,806,189 | A * | 9/1998 | Bailey | 30/125 |
| 5,906,049 | A * | 5/1999 | Butts | 30/125 |
| 6,000,139 | A * | 12/1999 | Chan | 30/358 |
| 6,530,304 | B1 * | 3/2003 | Nelson et al. | 83/620 |
| 6,672,191 | B2 * | 1/2004 | Lin | 83/549 |
| 6,895,674 | B2 * | 5/2005 | Ai | 30/353 |
| 2002/0078572 | A1 * | 6/2002 | Linton et al. | 30/294 |
| 2005/0034312 | A1 * | 2/2005 | Ai | 30/353 |
| 2005/0144787 | A1 * | 7/2005 | Macri | 30/142 |

* cited by examiner

*Primary Examiner*—Maurina Rachuba
(74) *Attorney, Agent, or Firm*—Michael Diaz

(57) ABSTRACT

The present invention is a cutting apparatus for cutting and removing plastic material from a package as well as an apparatus for cutting boxes or tape. The cutting apparatus includes a main body having an applicator end and an opposite handle end. Within the main body is a slidable base having a piercing device with a sharp pointed end for piercing the material located on a first end. On an opposite second end is a cutting device for pulling and cutting the material. The cutting device has a hook-shaped tip and a cutting edge adjacent the hook-shaped tip. A device may be selected and extended through the applicator end by positioning a selector button to position the selected device adjacent a slotted opening in the applicator end. The cutting device and the piercing device are extended by sliding the base along a longitudinal track within the interior of the main body.

8 Claims, 6 Drawing Sheets

CUTTING APPARATUS FOR PLASTIC-ENCASED AND CORRUGATED PACKAGES

FIELD OF THE INVENTION

This invention relates to cutting tools. Specifically, the present invention relates to a dual purpose cutting and piercing apparatus for cutting and piercing open plastic material from a package and cutting and piercing corrugated packages.

DESCRIPTION OF THE RELATED ART

It is commonplace to find many products encased in a clear plastic material. Manufacturers often use a plastic packaging material for a wide variety of reasons ranging from protecting the product from damage to providing an anti-theft precaution. However, although there are several reasons why the manufactures utilize plastic material to encase goods, there are some significant disadvantages to using this plastic material. In particular, the consumer oftentimes has significant difficulties in opening these plastic encased packages.

One such example of this plastic packaging is clam-shell heat sealed plastic packages. This plastic packaging is extremely difficult to cut through. The plastic does not easily separate from the package. Additionally, the plastic packaging (e.g., packaging containing various electronic items, such as CD players, calculators, batteries, etc.) does not include any way of easily cutting through the plastic material to allow the removal of the item inside without some type of cutting tool.

To open such packages, existing tools used by consumers include knives, box cutters and other sharp objects to pierce and cut through plastic. However, these cutting devices are not safe and merely pierce the plastic without providing any mechanism to smoothly cut the plastic material or remove it from the package. When a knife is used to pierce the plastic, the consumer still cannot cut through curves and angles of the plastic to safely tear it away from the package.

Additionally, employees of retail stores or large companies encounter packages having a strong plastic layer covering products. Many employees encounter a large amount of these packages which requires repetitive removal of the plastic material. Because these packages are not easy to open, employees utilizing sharp cutting tools are prone to accidents because of the frequency of their actions and the difficulty in opening the packages.

Currently, there is no existing cutting device which can easily pierce a plastic material from a package, cut the plastic material as desired away from the package, cut around curves and corners associated with the package, and allow the easy removal of the plastic material in a safe and efficient manner. It would be advantageous to have a cutting apparatus which incorporates a piercing tool with a mechanism to allow the plastic material to be easily cut and removed from a package without damaging the product inside of the package. It is an object of the present invention to provide such an apparatus.

SUMMARY OF THE INVENTION

In one aspect, the present invention is a cutting apparatus for cutting material covering an object. The cutting apparatus includes a main body having a handle located on a first end for grasping by a user and an applicator end located on a second end opposite the first end. The cutting apparatus also includes a compartment having a slidable base with a piercing device on a first end and cutting device on a second opposite end. The compartment is positioned within the main body. The base may be positioned to allow selection of the piercing device or the cutting device. The selected device is positioned adjacent the applicator end and extended through the applicator end. The compartment may be optionally removed from the handle. In addition, the cutting device preferably includes a hook-shaped tip and an adjacent cutting edge. The piercing device is used for piercing the material while the cutting device cuts the material.

In another aspect, the present invention is a cutting tool for cutting material. The cutting tool includes a main body having an applicator end. Additionally, the cutting tool includes a piercing device having a sharp pointed end for piercing the material and a cutting device for pulling and cutting the material. The desired tip may be selected and positioned adjacent the applicator end, the selected tip being extended through the applicator end.

In still another aspect, the present invention is a cutting apparatus for cutting and removing plastic material from a package. The cutting apparatus includes a main body having an applicator end and an opposite handle end. Within the main body is a slidable base having a piercing device with a sharp pointed end located on a first end for piercing the material. On an opposite second end is a cutting device for pulling and cutting the material. The cutting device has a hook-shaped tip and a cutting edge adjacent the hook-shaped device. A device may be selected and extended through the applicator end by positioning a selected device adjacent the applicator end. The cutting device and the piercing device are each extendable by sliding the base forward to an extended position. However, each device is stowed in a closed position when not adjacent the applicator end. When the selected device is adjacent the applicator end, the device is extended through a slotted opening in the applicator end to expose the selected device from the applicator end.

DESCRIPTION OF THE INVENTION

Figure 1:
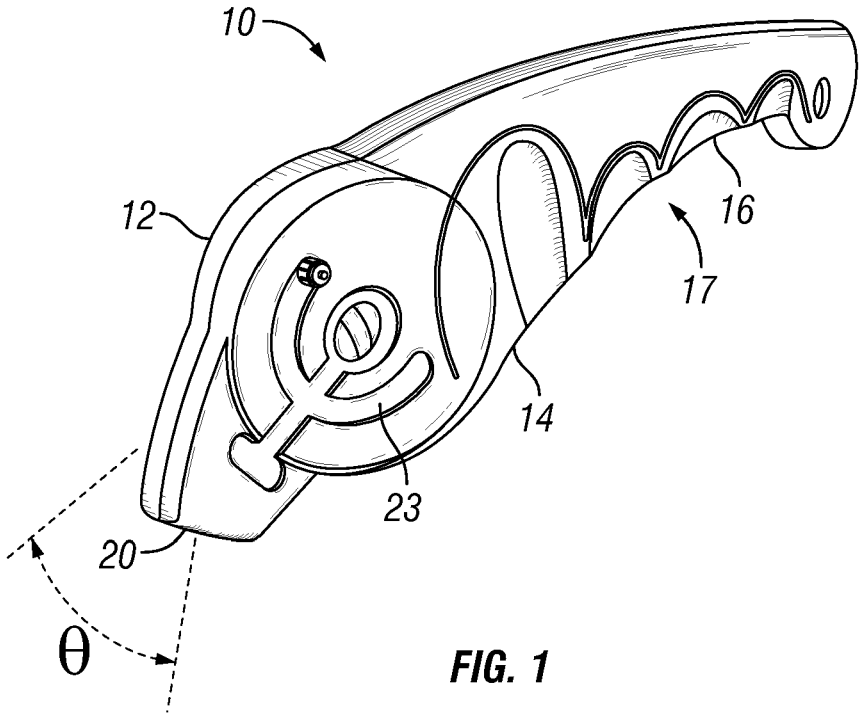
FIG. 1 is a front perspective of a cutting apparatus in the preferred embodiment of the present invention.
Figure 2:
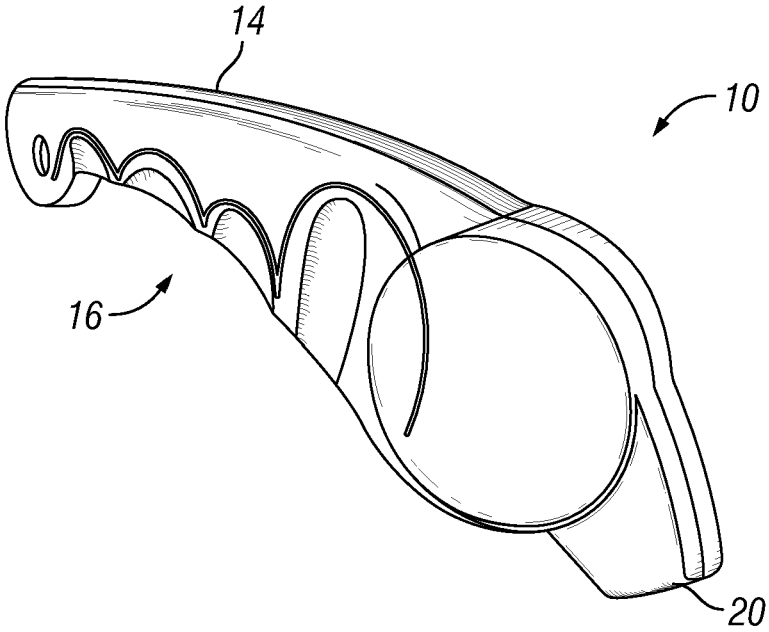
FIG. 2 is a rear perspective view of the cutting apparatus of FIG. 1.

A cutting apparatus for cutting and removing a plastic or cardboard material from a package is disclosed. FIG. 1 is a front perspective of a cutting apparatus 10 in the preferred embodiment of the present invention. FIG. 2 is a rear perspective view of the cutting apparatus of FIG. 1. The cutting apparatus includes a compartment 12, a main body 14 having a handle 16, and an applicator end 20.

The main body 14 is preferably constructed of a rigid plastic encompassing a hollow housing. The handle 16 may also include indentations to form a handhold 17 to provide a grip for a user of the cutting apparatus. The cutting apparatus is sized and shaped to fit comfortably in an adult's hand. In the preferred embodiment of the present invention, the cutting apparatus is approximately 5 inches long and 2 inches high.

It should be noted that the piercing device and the cutting device explained below are orientated with an angle of θ of approximately 45 degree angle in relation to the handle 16. This angle provides an orientation of the tips in relation to the plastic material in such a manner which is easy for the user to pierce and cut the plastic material. A removable consumable 23 is housed within the compartment and may be removed from the handle 16 by any attachment mechanism. For example, the consumable 23 may be removed by unlocking the cover. The consumable may then be replaced or placed in the pocket-sized apparatus. The consumable is interchangeable with the pocket-sized apparatus (FIG. 3) and the larger preferred apparatus (FIG. 1).

Figure 3:
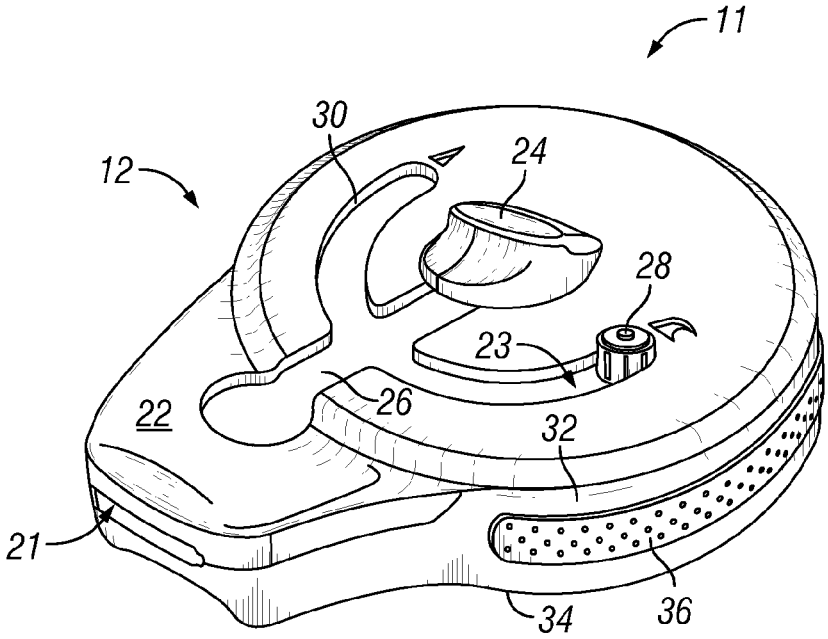
FIG. 3 is a top perspective view of a pocket-sized cutting apparatus having the compartment in a standalone configuration in an alternate embodiment of the present invention.

FIG. 3 is a top perspective view of a pocket-sized cutting apparatus 11 having the compartment 12 in a standalone configuration in an alternate embodiment of the present invention. In this version, the cutting apparatus 11 does not include the main body 14, which makes it ideal for storage in a user's pocket. However, it should be understood that the description below of the compartment 12 may apply for the pocket-sized cutting apparatus 11 or the full-sized cutting apparatus 10.

Still referring to FIG. 3, on an upper surface 22 of the compartment is a slide button 24 positioned within a longitudinal track 26. As depicted, the slide button is positioned in the safe position, without any cutting devices being extended. The slide button may be slid down the longitudinal track 26 towards the front portion of the compartment to extend a cutting device. A selector button 28 is positioned within a semicircular track 30. The selector button may be slid from the right position (shown in FIG. 3) to the left position to select one of two cutting devices to be explained below. The applicator end 20 includes a slotted opening 21 which allows a cutting device to extend outwardly from the compartment.

The compartment is preferably constructed of an upper casing 32 and a lower casing 34 in a clam shell design which is preferably connected by molding 36 surrounding a substantial portion of the compartment. Preferably, the compartment is constructed of a strong rigid material such as a heavy duty plastic.

Figure 4:
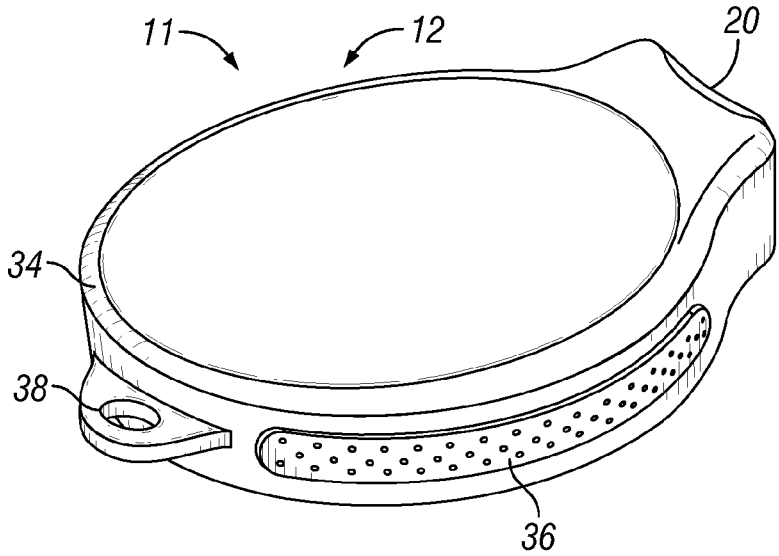
FIG. 4 is a bottom perspective view of the compartment of FIG. 3.

FIG. 4 is a bottom perspective view of the pocket-sized cutting apparatus 11 with the compartment 12 of FIG. 3. The compartment preferably includes a relatively planar surface area for the lower casing. In addition, the compartment 12 may include a keyhole loop 38 located on an opposite end from the applicator end 20. The keyhole loop allows the attachment of keys upon the compartment.

Figure 5:
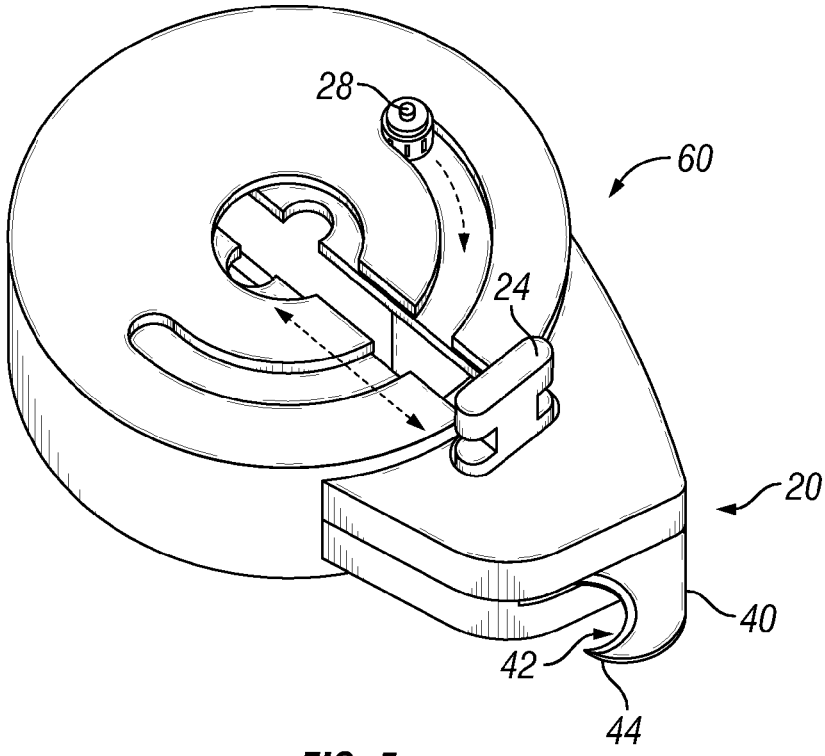
FIG. 5 is a top perspective view of the pocket-sized cutting apparatus of FIG. 3 with a hook-shaped cutting device extended from the applicator end.

FIG. 5 is a top perspective view of the pocket-sized cutting apparatus 11 of FIG. 3 with a hook-shaped cutting device 40 extended from the applicator end 20. The slide button 24 is extended forward to extend the cutting device 40. The cutting device 40 includes a curved cutting edge 42 and a hook-shaped tip 44. The cutting edge is preferably very sharp to allow easy cutting of plastic or corrugated cardboard. The hook-shaped tip is preferably covered with a plastic or other similar material. The cutting device is preferably constructed of a rigid material such as steel or heavy duty aluminum.

Figure 6:
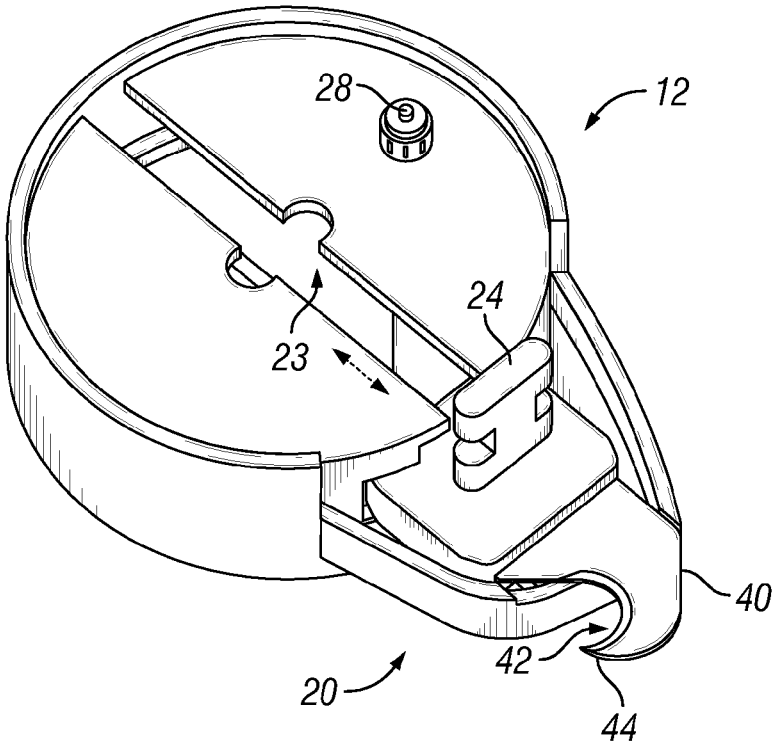
FIG. 6 is a top interior view of the compartment of FIG. 5 and the consumable.

FIG. 6 is a top interior view of the compartment 12 of FIG. 5. The compartment houses the removable consumable 23 having the cutting device 40. The slide button may be spring-loaded to an upward position for locking the slide button in place. Preferably, the slide button must be depressed to move the slide button within the longitudinal track 26.

Figure 7:
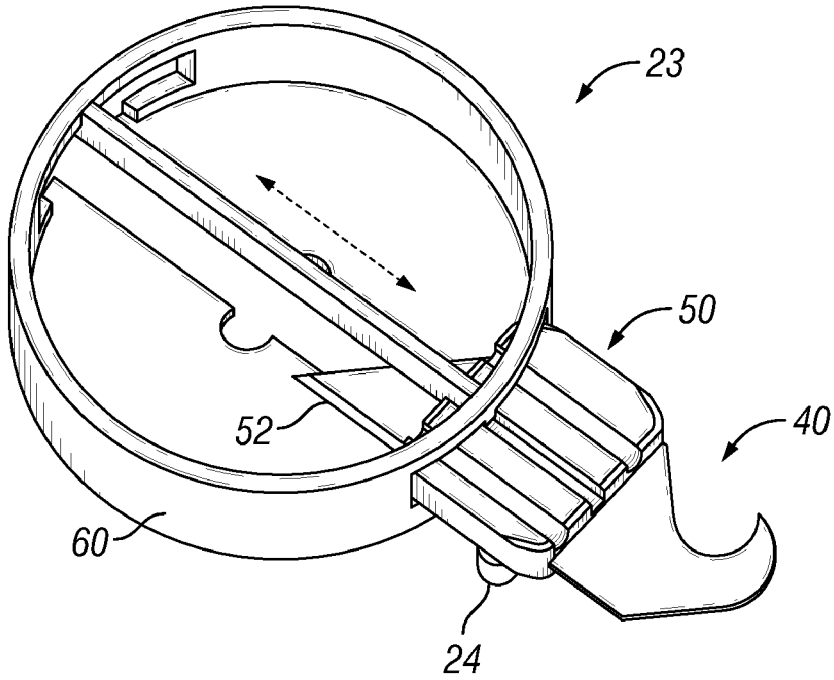
FIG. 7 is a bottom interior view of the compartment of FIG. 5 illustrating the consumable with the hook-shaped cutting device extended.

FIG. 7 is a bottom interior view of the consumable 23 and the hook-shaped cutting device 40 extended. The hook-shaped cutting device 40 is attached to a slidable base 50. On an opposite side of the cutting device 40 is a piercing device 52. The consumable 23 includes the slidable base, the cutting device, the slide button 24, and the piercing device all housed within an interior shell 60. The consumable may be removable as desired by the user. The piercing device is also preferably constructed of steel or aluminum. The base is also rotatable, allowing selection of either the piercing device or the cutting device as desired by the user. The base is rotated to allow the cutting device or the piercing device to be positioned adjacent the slotted opening 21. The piercing device may be used to pierce and/or cut a material.

Figure 8:
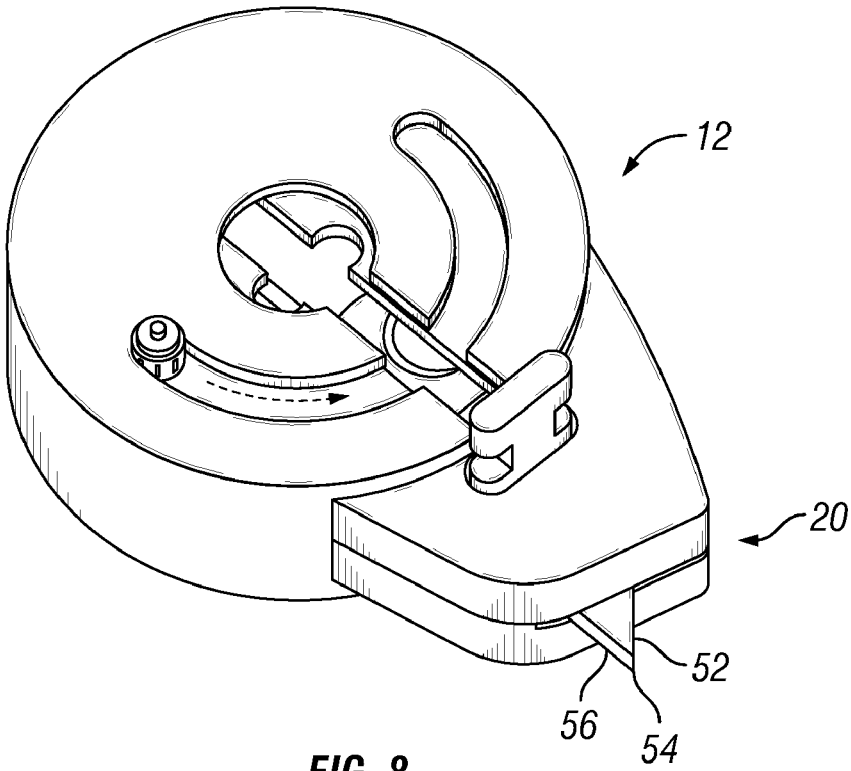
FIG. 8 is a top view of the compartment with the piercing device extended.

FIG. 8 is a top view of the compartment 12 with the piercing device 52 extended. The piercing device 52 includes a sharp tip 54 and a straight cutting edge 56. The piercing device is particularly useful for piercing plastic to allow positioning of the cutting device 40 underneath the plastic or cutting corrugated cardboard or tape. The selector button is slide to the left position to allow selection of the piercing device. To select the cutting device 40, the selector button 28 is slid to the right position as depicted in FIG. 5.

Figure 9:
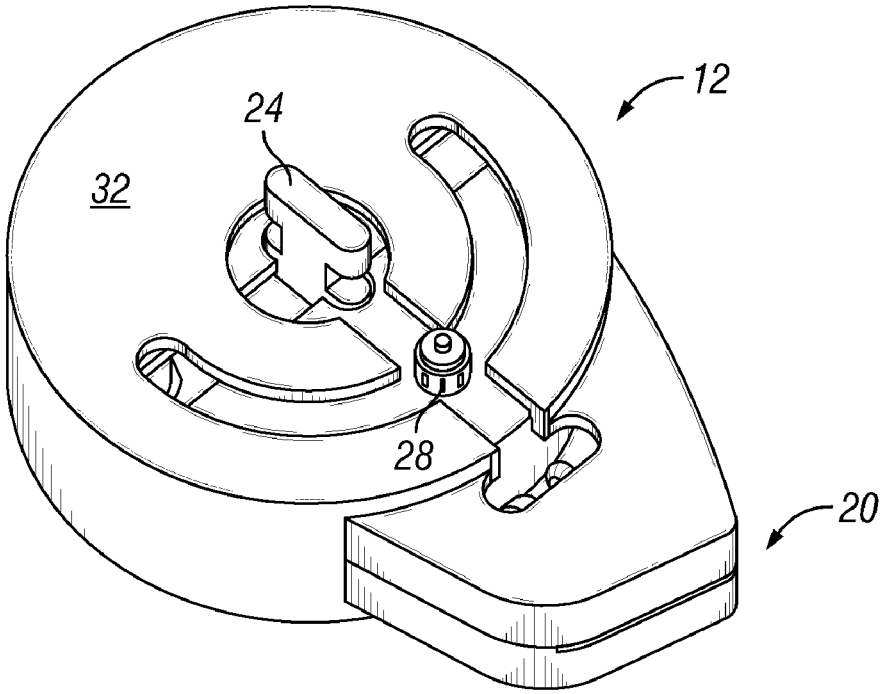
FIG. 9 is a top perspective view of the compartment in the safe position.

FIG. 9 is a top perspective view of the compartment 12 in the safe position. In the safe position, the slide button 24 is slid rearward and the selector button 28 is positioned in a middle position. To select a cutting device or piercing device, the selector button must be set to the right or left position and the slide button must be slid forward. To slide the slide button forward, the user preferably must depress the spring-loaded slide button down.

Figure 10:
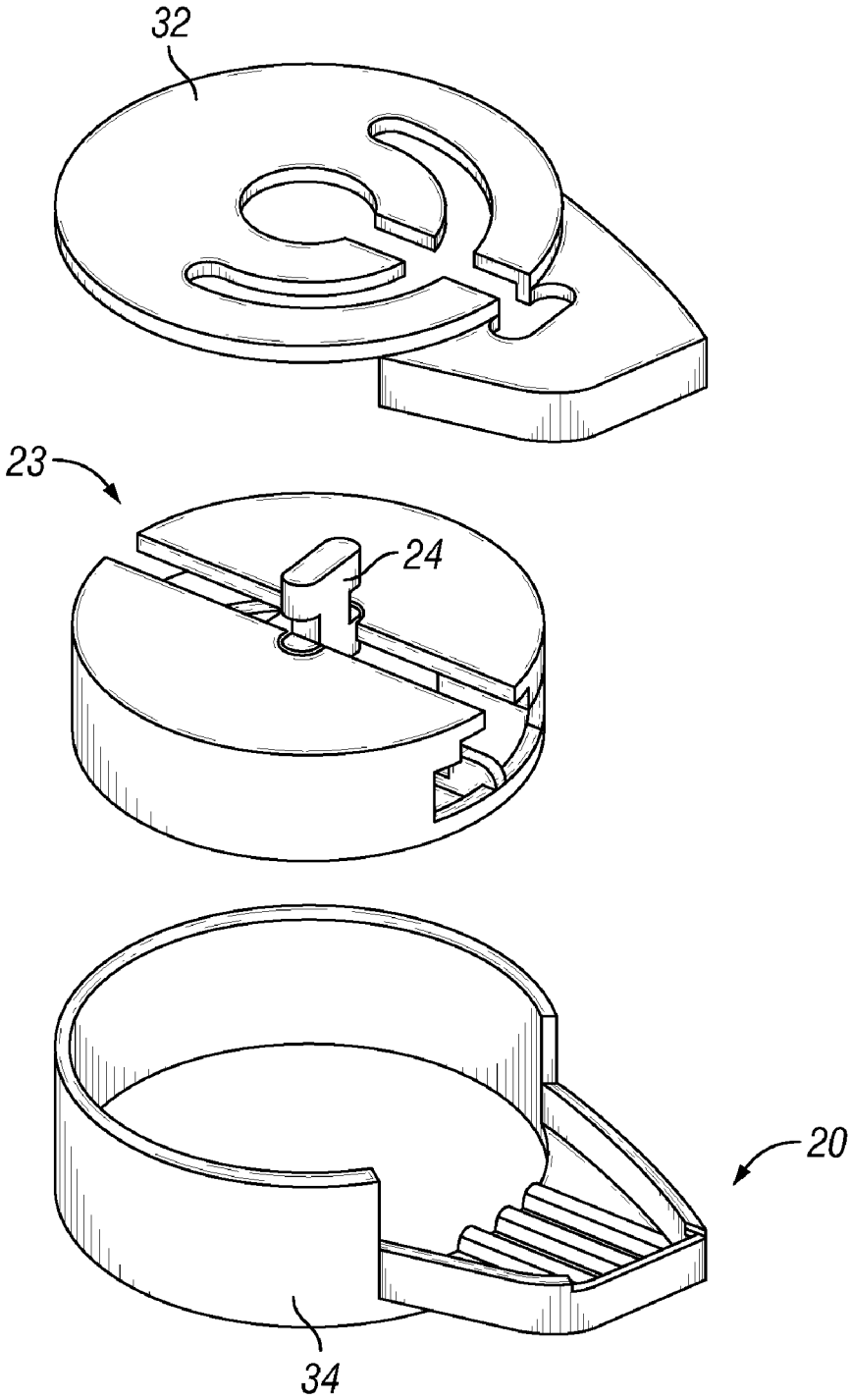
FIG. 10 is an exploded view of the pocket-sized cutting apparatus.

FIG. 10 is an exploded view of the compartment 12. Within an interior portion of the compartment 12 is the consumable 23 having the interior shell 60 which stores the cutting and piercing devices. This shell may be replaceable as needed. The interior shell allows easy replacement of the cutting/piercing devices without the user touching the sharp cutting surfaces.

It should be understood that the cutting and piercing devices may be extended by any mechanism which enables the devices to be extended from a retracted position. In an alternate embodiment of the present invention, the devices may be rigidly fixed in an extended position. Additionally, although a cutting device and piercing device is depicted, any cutting device may be used and still be within the scope of the present invention.

With reference to FIGS. 1-10, the operation of the compartment 12 for use on the cutting apparatus will now be explained. When not in use, the cutting apparatus may position the cutting and piercing devices in the safe or stowed position as illustrated in FIG. 9. Specifically, the slide button is depressed and slid rearward along the longitudinal tack 26 to the fully rear position. The selector button is positioned in a middle position, thereby positioning the cutting and piercing devices away from the slotted opening 21.

When it is desired to open a package, the user may slide the selector button 28 along the semicircular track 30 to either the left or right position. By position the selector button to the right or left, either the cutting device or the piercing device is positioned adjacent the slotted opening. The slide button 24 is then depressed and slid forward to extend the selected device. The user may then grasp the handle 16 and use the piercing device to pierce the packaging material, such as the plastic material. Once the material is pierced, the slide button is depressed and moved rearward. The selector button may then be positioned to the opposite side. Next, the slide button is depressed and slide forward to extend the hook-shaped cutting device 40. The user may then utilize the hook-shaped tip 44 to pull up upon the plastic material, thereby exposing the plastic material to the cutting edge 42. Additionally, the hook-shaped tip acts as a guide for the cutting edge 42. The cutting edge may then easily cut through the plastic material without damaging the product enclosed within the plastic material. The cutting edge may then cut in any direction as desired by the user. Because of the hook-shaped tip ability to guide the cutting edge, a shearing action is created during the cutting process, thereby enhancing the ability of the cutting apparatus to cut through the plastic material. Additionally, because of the configuration of the tip and plastic coating, the cutting apparatus may cut around edges and corners with ease. As desired, the plastic material may then be removed from the product.

When use of the cutting apparatus is complete, the slide button 24 is depressed and slid rearward. The selector button 28 is then positioned in the middle position (FIG. 9) to safely store the sharp edges of the cutting apparatus. In this stowed position, the cutting apparatus may be safely handled and stowed without danger of inadvertently cutting or piercing a person or object. The consumable 23 may be removed (FIG. 7) as desired by the user from the compartment. The consumable includes the blades (i.e., hook-shaped cutting device and piercing device) and the slidable base 50. When the blades are worn or require replacing, the entire consumable may be removed from the compartment and replaced. In the same fashion as the pocket-sized cutting apparatus 11, the consumable may be removed from the compartment of the cutting apparatus 10.

The cutting apparatus may be utilized on a surface requiring cutting and is not limited to plastic covered products or cardboard. The cutting apparatus may allow a user to simply use the piercing tip or the cutting tip. Additionally, the cutting apparatus is particularly useful for removing cardboard packaging from a product (e.g., corrugated box opener). A novel feature of the present invention is the singular blade having the dual purpose of a piercing device and a cutting device. Additionally, the compartment allows the easy removal and replacement of the dual purpose piercing device and cutting device, thereby providing easy and safe replacement of the devices within the compartment.

The present invention provides many advantages over existing cutting devices. The present invention enables a user to pierce a material and then easily cut through the material by use of at least two extendable tips. The cutting tip allows the user to separate the material from a product and easily cut the exposed material without damage to the product. The present invention is easily carried by the user and may be positioned in a stowed position for added safety.

It should be understood that the present invention is not limited to the removal of plastic material from a package. The piercing tip and cutting tip may be used to cut other types of material as needed. Additionally, the cutting apparatus may include other types of tips, such as cutting surfaces formed in different shapes.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A cutting tool for cutting material, the cutting tool comprising:

a main body having an applicator end;

a piercing device for piercing the material, the piercing device have a sharp pointed end;

a cutting device for pulling and cutting the material; and a slidable base positioned within a longitudinal track within an interior portion of the main body, the slidable base having the cutting device on a first end and the piercing device on the second end; and the applicator end having a slotted opening for receiving the extended device;

wherein the base is rotatable within the interior portion of the main body to allow positioning of the cutting device or the piercing device through the slotted opening when the slide button is positioned forward;

a selector button positioned within a selector track for rotating the base within the interior portion of the main body, the selection button having a first position for selecting the cutting device and a second position for selecting the piercing device;

whereby the selector button is placed in the first or second position to rotate the base to position the selected device adjacent the slotted opening, the selected device being extended through the slotted opening to expose the selected device.

2. The cutting apparatus for cutting material covering an object of claim 1 wherein the material being cut is plastic.

3. The cutting apparatus for cutting material covering an object of claim 1 wherein the slidable base includes the piercing device on a first end and the cutting device on a second opposite end.

4. The cutting tool for cutting material of claim 1 wherein the slidable base is spring-loaded to a locked position preventing movement of the slidable base, whereby depression of the slide button is required to slide the base along the longitudinal track.

5. The cutting tool for cutting material of claim 1 wherein the main body is attached to a handle.

6. The cutting tool for cutting material of claim 1 wherein the cutting edge includes a hook-shaped tip and a cutting edge adjacent the hook-shaped tip.

7. The cutting tool for cutting material of claim 1 wherein the cutting device and the piercing device when extended are orientated approximately 45 degrees in relationship to the handle.

8. The cutting tool for cutting material of claim 1 wherein a consumable component having the slidable base, the cutting device and the piercing device is removable from the main body.

* * * * *